US007927079B2

(12) United States Patent
Suzuki et al.

(10) Patent No.: US 7,927,079 B2
(45) Date of Patent: Apr. 19, 2011

(54) ELECTRICALLY OPERATED HYDRAULIC PUMP

(75) Inventors: Shigemitsu Suzuki, Takahama (JP); Shigeharu Yamamoto, Kariya (JP); Naoto Toma, Kariya (JP)

(73) Assignee: Aisin Seiki Kabushiki Kaisha, Kariya-shi (JP)

( * ) Notice: Subject to any disclaimer, the term of this patent is extended or adjusted under 35 U.S.C. 154(b) by 873 days.

(21) Appl. No.: 11/862,911

(22) Filed: Sep. 27, 2007

(65) Prior Publication Data

US 2008/0075608 A1 Mar. 27, 2008

(30) Foreign Application Priority Data

Sep. 27, 2006 (JP) ..... 2006-262669

(51) Int. Cl.

| | |
|---|---|
| ***F04B 49/10*** | (2006.01) |
| ***F04B 49/06*** | (2006.01) |
| ***H02P 6/04*** | (2006.01) |
| ***H02P 6/18*** | (2006.01) |

(52) U.S. Cl. . 417/32; 417/44.1; 417/44.11; 318/400.11; 318/400.34

(58) Field of Classification Search ..... 417/18, 417/22, 32, 42, 44.1, 366; 318/400.03, 400.09, 318/400.11, 400.34, 400.37

See application file for complete search history.

(56) References Cited

U.S. PATENT DOCUMENTS

| | | | | |
|---|---|---|---|---|
| 5,970,733 | A * | 10/1999 | Hamaoka et al. | 62/228.4 |
| 6,396,229 | B1 * | 5/2002 | Sakamoto et al. | 318/400.02 |
| 6,462,492 | B1 * | 10/2002 | Sakamoto et al. | 318/400.32 |
| 7,036,892 | B2 * | 5/2006 | Suzuki et al. | 303/116.4 |

FOREIGN PATENT DOCUMENTS

JP 2002-317772 A 10/2002

* cited by examiner

*Primary Examiner* — Charles G Freay

(74) *Attorney, Agent, or Firm* — Sughrue Mion, PLLC

(57) ABSTRACT

An electrically operated hydraulic pump having a pump portion and a motor portion includes rotation controlling means controlling rotation of a rotor, first rotor position detecting means detecting rotational position of the rotor on the basis of speed electromotive force induced by exciting coils, second rotor position detecting means detecting the rotational position of the rotor on the basis of magnetic field of a magnet provided at the motor portion, and motor operating condition detecting means detecting operating condition of the motor portion. The rotation controlling means switches a first rotation controlling based on the rotational position of the rotor detected by the first rotor position detecting means, and a second rotation controlling based on the rotational position of the rotor detected by the second rotor position detecting means, on the basis of a result detected by the motor operating condition detecting means.

19 Claims, 4 Drawing Sheets

ELECTRICALLY OPERATED HYDRAULIC PUMP

CROSS REFERENCE TO RELATED APPLICATIONS

This application is based on and claims priority under 35 U.S.C. §119 to Japanese Patent Application 2006-262669, filed on Sep. 27, 2006, the entire content of which is incorporated herein by reference.

FIELD OF THE INVENTION

The present invention relates to an electrically operated hydraulic pump which includes a pump portion and a motor portion including a brushless DC motor, and which detects a rotational position of the rotor included in the motor, on the basis of speed electromotive force induced by exciting coils of the motor portion.

BACKGROUND

An electrically operated hydraulic pump is used for supplying operating oil as fluid to a clutch of an automatic transmission mounted on a vehicle such as an automobile, or for supplying cooling oil as fluid to an electric motor mounted on a hybrid type vehicle, and so on. A mechanical hydraulic pump, an electrically operated hydraulic pump, and so on can be employed as a pump mounted on a vehicle. The mechanical hydraulic pump uses driving force of an engine of the vehicle, while the driving force of the engine is not required to the electrically operated hydraulic pump. Before starting the engine, or immediately after the engine started, effective hydraulic pressure is not supplied from the mechanical hydraulic pump. Accordingly, there is a requirement to employ the electrically operated hydraulic pump in such situations.

A conventional electronic operated hydraulic pump is described in Japanese Patent No. 2002-317772 A (hereinafter, referred to as a reference 1). The electrically operated hydraulic pump according to the reference 1 includes a motor portion and a pump portion. The motor portion structures a sensor-less brushless DC motor. The pump portion absorbs and exhausts fluid by means of driving force of a rotating shaft driven by the motor portion. The motor portion includes a stator, a rotor and rotation controlling means. The stator includes plural exciting coils for generating a magnetic field. The rotor includes a magnet which faces the exciting coils and is arranged to be rotatable with the rotating shaft in a space inside of a resin-mold and closed-bottom cylindrical motor housing. The rotation controlling means controls rotation of the rotor by switching electric current of the exciting coils in accordance with a rotating position of the rotor. Further according to the electrically operated hydraulic pump in the reference 1, a fluid returning path is formed between the motor portion and the pump portion. Fluid flowing into a space inside the motor from the pump portion can be returned to the pump portion through the fluid returning path. In other words, the fluid circulates between the pump portion and the space inside the motor portion and therefore, the space of the motor portion, i.e., the stator and the rotor, is cooled. However, when temperature of the fluid is low and viscosity of the fluid is high, rotational resistance for the rotor may be increased because of the fluid adhering to the rotor inside the space of the motor.

As described above, according to the electrically operated hydraulic pump in reference 1, the sensor-less DC motor is employed so that there is an advantage that any particular apparatus for detecting a rotational position or the rotor position, or the like, may not be provided. Further, there is another advantage that the pump can be downsized because any particular apparatus for cooling the rotor of the motor portion, or the like, may not be provided.

The electrically operated hydraulic pump according to the reference 1 detects the rotational position of the rotor on the basis of speed electromotive force induced by the exciting coils. Accordingly, when the rotational speed of the rotor is high, detection precision of the rotational position of the rotor is also increased. However, when the rotation speed of the rotor is not high, the detection precision of the rotational position of the rotor may be decreased. Here, when the temperature of the fluid is low, the rotational speed of the rotor lowers because the viscosity of the fluid is high, i.e., because the fluid may become large rotational resistance to the rotor. Accordingly, when the temperature of the fluid is high, the detection precision of the rotational position of the rotor is increased, while when the temperature of the fluid is low, the detection precision of the rotor rotational position may be lowered. Specifically, before starting the engine or immediately after the engine started, i.e., before the motor is operated or immediately after the motor is operated, the temperature of the fluid may be low and the rotational speed of the rotor may not be increased because the viscosity of the fluid may be high. Accordingly, there is a possibility that the detection precision of the rotor is decreased. Consequently, the rotation of the motor may not be controlled adequately.

A need thus exists for an electrically operated hydraulic pump which is not susceptible to the drawback mentioned above.

SUMMARY OF THE INVENTION

According to an aspect of the present invention, an electrically operated hydraulic pump includes a motor portion and a pump portion. The motor portion of the electrically operated hydraulic pump includes a hollow and cylindrical motor housing with a bottom and an opening, and a brushless DC motor having a stator which is fixedly provided in the motor housing, a plurality of exciting coils which generates magnetic field, and a rotating shaft which is arranged at a space in the motor housing to be rotatable relative to the stator. The brushless DC motor of the motor portion further has a rotor which is arranged at the space in the motor housing and fixed to the rotating shaft, the rotor which includes a first magnet facing the exciting coils, and rotation control means which controls a rotation of the rotor by switching energizing electric current flow from an exciting coil to another exciting coil, from among the exciting coils in accordance with a rotational position of the rotor. The pump portion of the electrically operated hydraulic pump, which is connected to one end of the rotating shaft, absorbs and exhausts fluid by driving force of the rotating shaft. The electrically operated hydraulic pump further includes first rotor position detecting means, second rotor position detecting means, and motor operating condition detecting means. The first rotor position detecting means includes speed electromotive force detecting means for detecting speed electromotive force induced by the exciting coils and detects the rotational position of the rotor on the basis of a result detected by the speed electromotive force detecting means. The second rotor position detecting means includes a second magnet which is provided at the rotating shaft, and a magnetic field detecting unit which detects magnetic field of the second magnet. The second rotor position detecting means detects the rotational position of the rotor on the basis of a result detected by the magnetic field detecting unit. The motor operating condition detecting means detects an operating condition of the motor portion. The electrically operated hydraulic pump according to the aspect of the present invention is characterized in that the rotation control means of the motor portion is configured to switch a first rotation controlling based on the rotational position of the rotor detected by the first rotor position detecting means and a second rotation controlling based on the rotational position of the rotor detected by the second rotor position detecting means, on the basis of a result detected by the motor operating condition detecting means.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Figure 1:
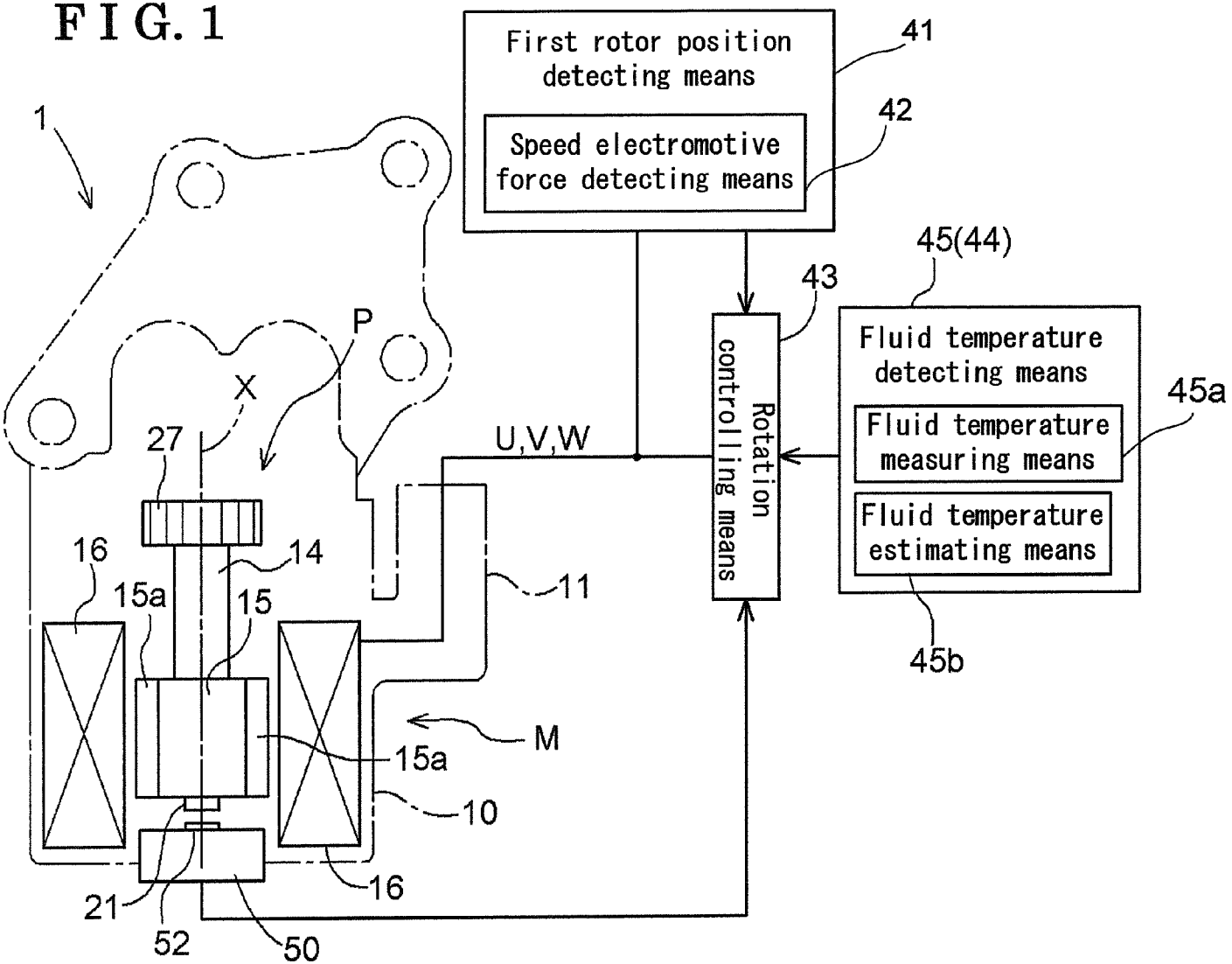
FIG. 1 is a longitudinal sectional view schematically illustrating an entire structure of an electrically operated hydraulic pump.
Figure 2:
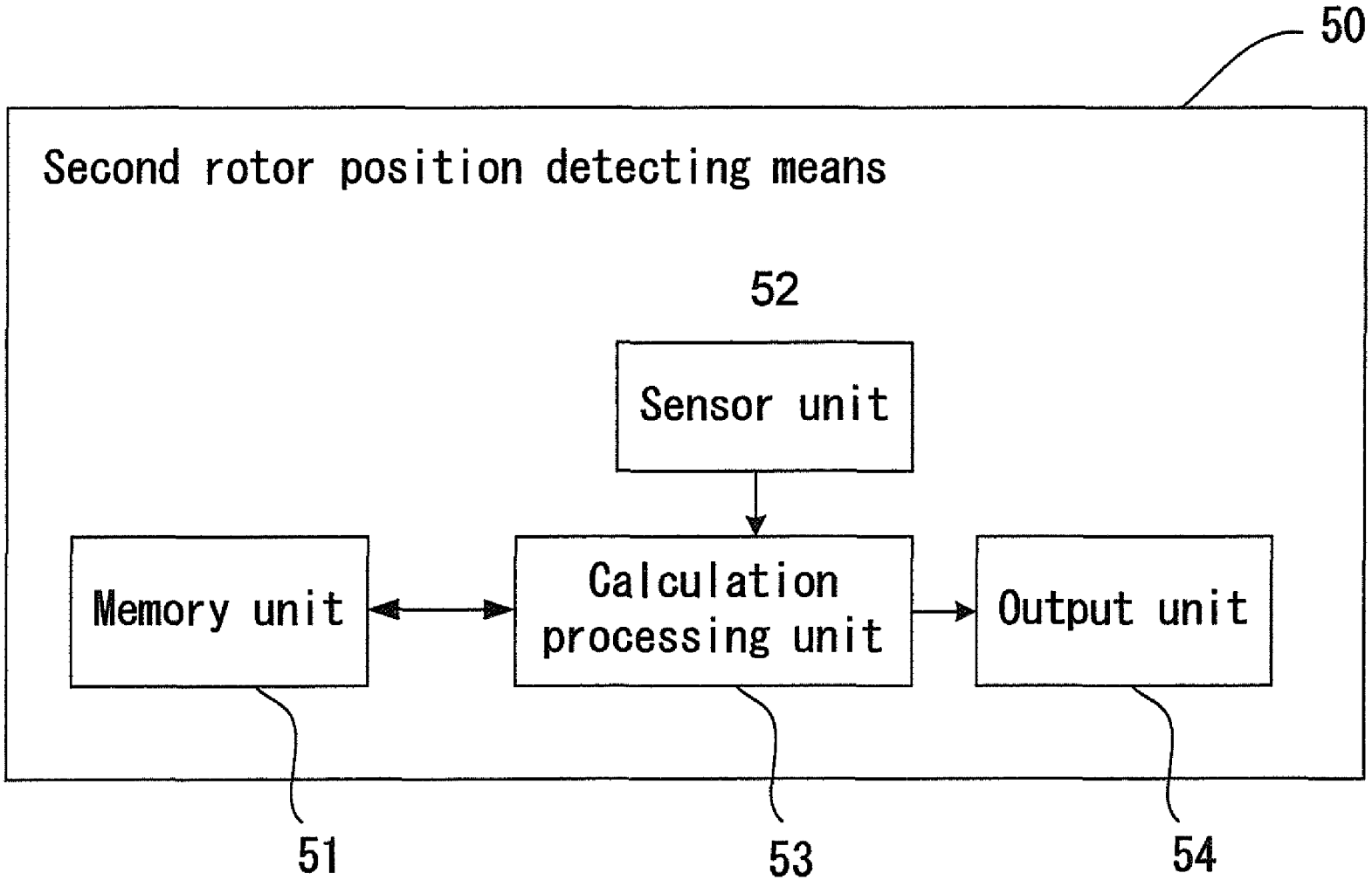
FIG. 2 is a functional block diagram illustrating a second rotor position detecting means of the electrically operated hydraulic pump illustrated in FIG. 1.
Figure 3:
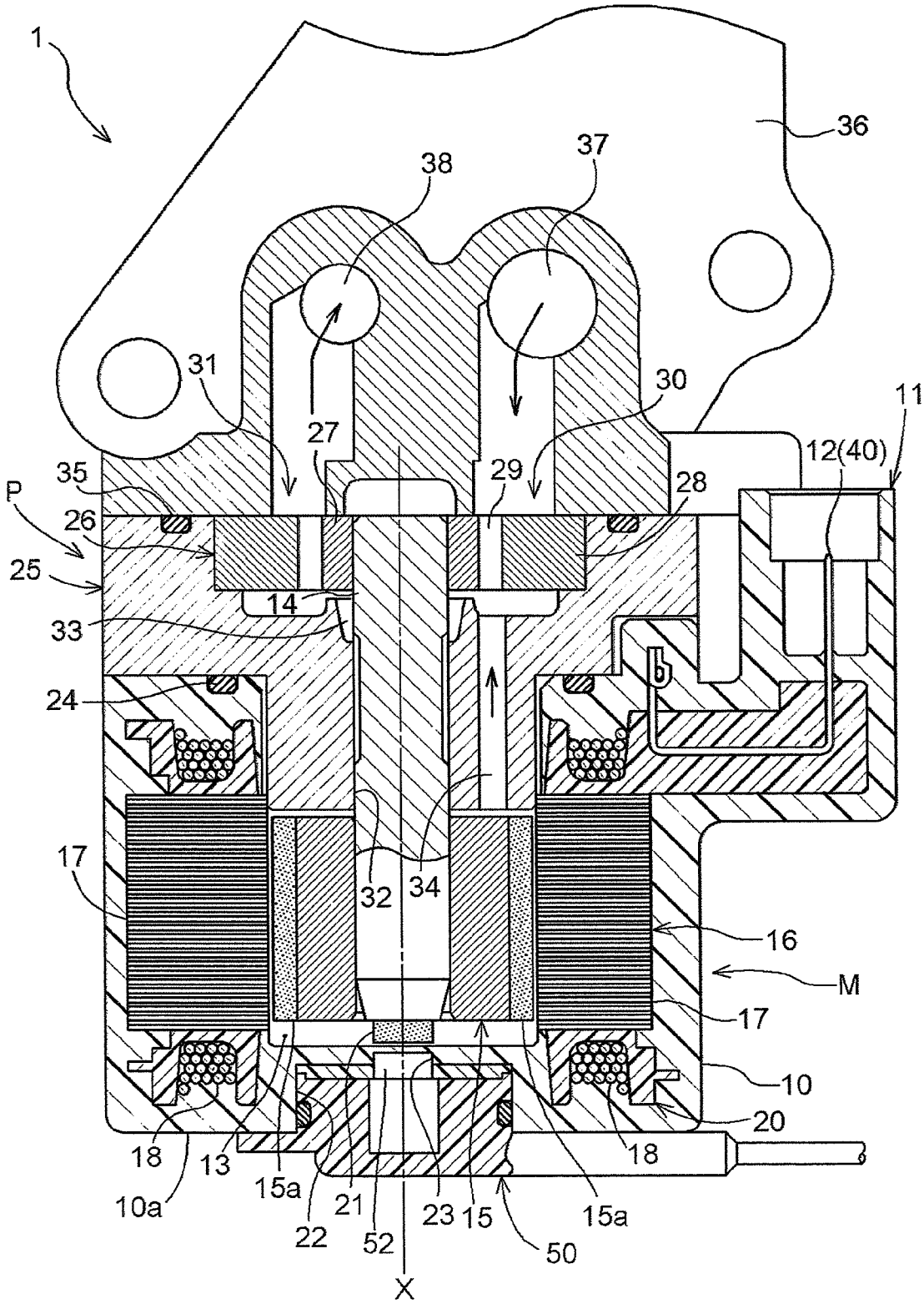
FIG. 3 is a longitudinal sectional view illustrating in detail the electrically operated hydraulic pump.
Figure 4:
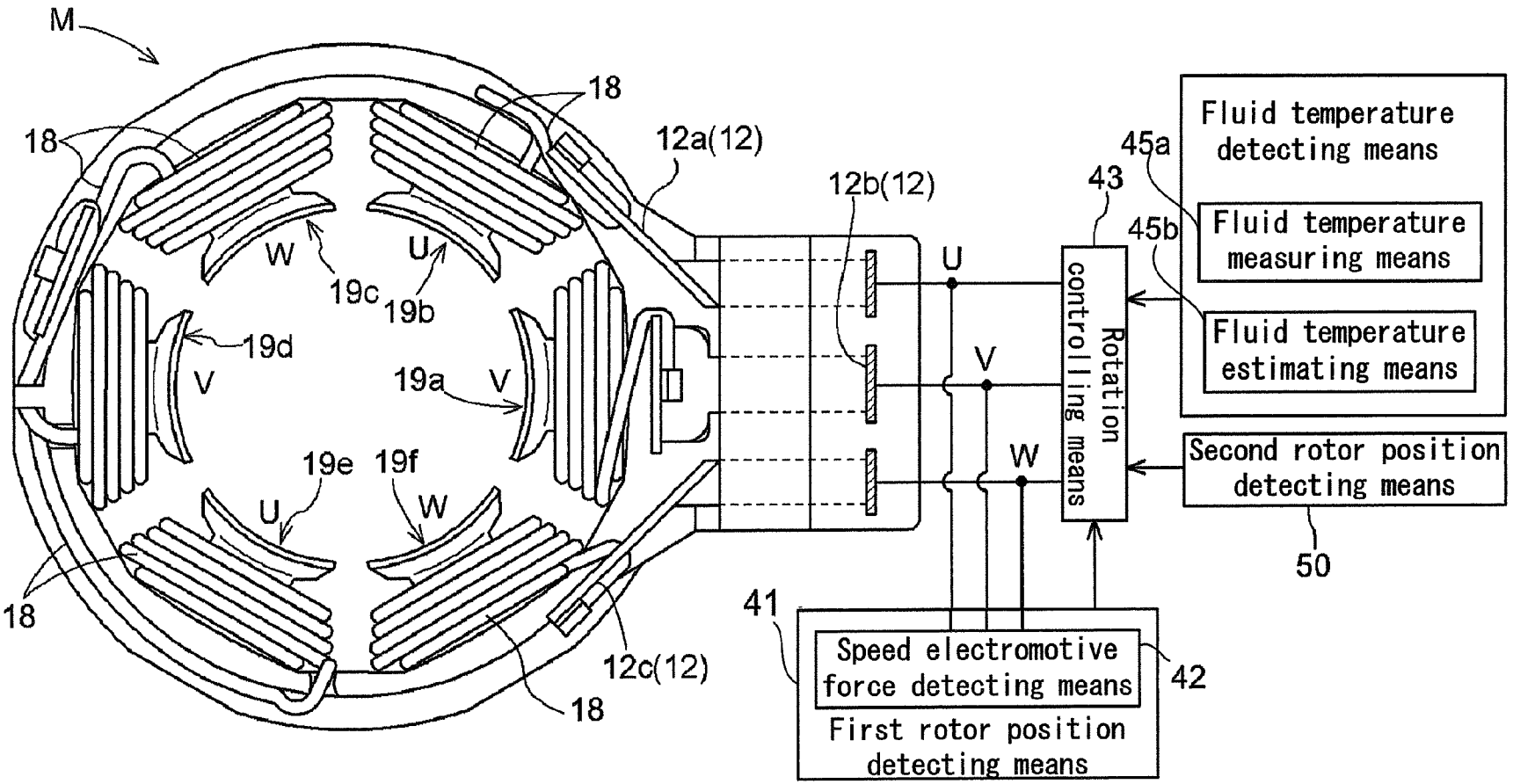
FIG. 4 is a top view of the motor portion of the electrically operated hydraulic pump.

An embodiment of the electrically operated hydraulic pump according to the present invention will be described hereinafter with reference to attached FIGS. 1 through 4. FIG. 1 is a longitudinal sectional view schematically illustrating an entire structure of the electrically operated hydraulic pump. FIG. 2 is a functional block diagram illustrating a second rotor position detecting means of the electrically operated hydraulic pump illustrated in FIG. 1. FIG. 3 is a longitudinal sectional view illustrating in detail the electrically operated hydraulic pump. FIG. 4 is a top view of the motor portion of the electrically operated hydraulic pump. As best shown in FIGS. 1 and 3, an electrically operated hydraulic pump 1 includes a motor portion M and a pump portion P. The motor portion M drives a rotating shaft 14 to rotate, by means of electric power supplied via a connecting portion 11. The pump portion P is provided at one end of the rotating shaft 14, and absorbs and exhausts fluid such as oil, water, or the like, by means of driving force of the rotating shaft 14. The electrically operated hydraulic pump 1 according to the embodiment is employed, for example, for supplying fluid-type operating oil to a clutch of an automatic transmission mounted on a vehicle such as an automobile, or for supplying fluid-type cooling oil to an electric motor mounted on a hybrid type vehicle, or the like. Among pumps mounted on the vehicle, even when a mechanical hydraulic pump, which is operated by driving force of an engine of the vehicle, is not available for supplying effective hydraulic pressure before starting the engine of the vehicle, or immediately after the engine started, the electrically operated hydraulic pump 1 supplies the effective hydraulic pressure. Further, even when the mechanical hydraulic pump supplies the effective hydraulic pressure, the electrically operated hydraulic pressure 1 is also available.

As illustrated in FIG. 3, the electrically operated hydraulic pump 1 further includes a hollow and cylindrical motor housing 10 with a bottom 10*a* and an opening, a pump body 25 and a pump cover 36. The motor housing 10 structures the motor portion M and is made of resin. Here, the hollow and cylindrical motor housing 10 may be a cup-shaped housing. The pump body 25 and the pump cover 36 structure the pump portion P. Components of the electrically operated hydraulic pump 1 are accommodated in the motor housing 10, in the pump body 25 and in the pump cover 36. A seal member 24 is provided between the motor housing 10 and the pump body 25. A seal member 35 is provided between the pump body 25 and the pump cover 36. Accordingly, the motor housing 10, the pump body 25, and the pump cover 36 are assembled. The pump portion P closes the opening of the resin-made hollow and cylindrical motor housing 10.

The motor housing 10 includes the connecting portion 11 and the motor portion M. The connecting portion 11 receives electric current from an external terminal (not illustrated) connected to the motor housing 10. The motor portion M drives the rotating shaft 14 by means of the electric power supplied via the connecting portion 11. Back to FIG. 1, the motor portion M includes a stator 16 and a rotor 15. The stator 16 includes plural exciting coils 18 for generating magnetic field. The rotor 15 includes a magnet 15*a*, which faces the exciting coils 18. The magnet 15*a* is arranged in a space 13, which is formed inside of the hollow and cylindrical motor housing 10, to be rotatable with the rotating shaft 14. The motor portion M further includes a rotation controlling means 43, which controls a rotation of the rotor 15 by switching energizing electric current from one exciting coil 18 to another exciting coil 18, from among the exciting coils 18, in accordance with a rotational position of the rotor 15. As described above, the motor portion M of the electrically operated hydraulic pump 1 according to the embodiment includes a brushless DC motor.

More specifically, the rotor 15 of the motor portion M is fixedly provided relative to the rotating shaft 14, and the stator 16 of the motor portion M is cylindrically provided around the rotor 15 with set space relative to the rotor 15. The stator 16 includes a core 17, a bobbin portion 20 and the exciting coils 18. The core 17 is formed by laminating plural iron plates. The bobbin portion 20 is formed of insulative resin material and partially covers a surface of the core 17. Each exciting coil 18 is wound around the bobbin portion 20 in a vertically circumferential direction, and the exciting coils 18 are arranged to surround the core 17 assuring insulation to the core 17. Further, the resin-made bobbin portion 20 retains the stator 16 and terminal members 12 (12*a*, 12*b* and 12*c*) which the connecting portion 11 includes. One end portion of each terminal member 12 is connected to the exciting coils 18 of the stator 16, while the other end portion of each terminal member 12 structures a connecting terminal 40 of the connecting portion 11. The terminal members 12 include plate-shaped metal material. Still further, a recessed portion 22 is formed at an outer surface of the bottom 10*a* of the motor housing 10 to be coaxial with an axis X of the rotating shaft 14. A diameter of the recessed portion 22 is arranged to be smaller than an inner diameter of the stator 16.

As illustrated in FIG. 4, six tooth portions are provided surrounding the core 17 and three terminal members 12*a*, 12*b*, and 12*c* are applied with alternating electric current voltage. Each phase of the alternating electric current voltage to the terminal member 12*a*, to the terminal member 12*b*, and to the terminal member 12*c* is different. Accordingly, the terminal member 12*b*, a tooth portion 19*a* and a tooth portion 19*d* are in phase V (V phase). The terminal member 12*a* and a tooth portion 19*b* and a tooth portion 19*e* are in phase U (U phase), and further, the terminal member 12*c*, a tooth portion 19*c* and a tooth portion 19*f* are in phase W (W phase).

Back to FIG. 3, the motor housing 10 is partially formed with a cylindrical portion including a closed-end portion and an opening portion. The connecting portion 11 includes the cylindrical portion and is configured in a manner where the connecting terminal 40 (i.e., the other end portions of the terminal members 12) protrudes into the cylindrical portion of the motor housing 10. Then, the external terminal, which supplies the electric power to the motor portion M, is inserted into the cylindrical portion so as to be in contact with the connecting terminal 40.

The pump body 25, which structures the pump portion P, contains a pump-operating portion 26. The pump operating portion 26 absorbs and exhausts the fluid by means of rotational force of the rotating shaft 14 which is driven by the motor portion M. In the embodiment, a trochoid-type pump is employed as the pump operating portion 26. The pump cover 36 accommodates an intake port 37 for intaking the fluid to the pump operating portion 26, and an exhaust port 38 for exhausting the fluid from the pump operating portion 26. The pump operating portion 26 includes an inner rotor 27 and an outer rotor 28. The inner rotor 27 is arranged inside the outer rotor 28, in a manner where external splines of the inner rotor 27 are engaged with internal splines of the outer rotor 28. A bearing bore 32 is formed inside the pump body 25 and the rotating shaft 14 is inserted into the bearing bore 32. Then, the inner rotor 27 is fixedly provided around the rotating shaft 14, which is driven by the motor portion M, and is rotated with the rotating shaft 14. Accordingly, plural pump operating chambers 29 are formed between the inner rotor 27 and the outer rotor 28. A volume of each pump operating chamber 29 is changed to be increased or reduced, in accordance with the rotations of the inner and outer rotors 27 and 28. When the volume of each pump operating chamber 29 is increased, negative pressure is generated inside each pump operating chamber 29 which is communicated to an intake chamber 30. Therefore, the fluid flows into each pump operating chamber 29 through the intake port 37 and the intake chamber 30. The fluid flowing into each pump operating chamber 29 is transferred to an exhaust port 31 in accordance with the rotation of the inner rotor 27, and is exhausted from the exhaust port 31. Accordingly, when the rotating shaft 14 is rotated by the driving force of the motor portion M, the fluid is sucked by the intake port 37 and is exhausted from the exhaust port 38.

The electrically operated hydraulic pump 1 according to the embodiment is formed with a cutout portion 33 for communicating the exhaust chamber 31 with the bearing bore 32, and is configured in order that the fluid comes out of a surface of the rotating shaft 14. On the other hand, the electrically operated hydraulic pump 1 is not provided with any means for preventing the fluid from being transferred to the motor portion M from the pump operating portion 26 through the surface of the rotating shaft 14. Accordingly, the fluid coming out from the pump operating portion 26 through the rotating shaft 14 flows into the space 13 of the motor portion M and is adhered to the rotor 15, the stator 16, and so on. Further according to the electrically operated hydraulic pump 1, a returning path 34 is provided between the motor portion M and the pump portion P. The returning path 34 communicates the motor portion M with the intake chamber 30 so that the fluid flowing into the space 13 of the motor portion M can return to the pump portion P. Then, when the negative pressure is generated inside the intake chamber 30, the fluid, which flows into the space 13 from the pump portion P, is partially sucked into the intake chamber 30 through the returning path 34, because of the negative pressure. As described above, a fluid recirculation system, in which the fluid flows from the pump portion P to the motor portion M and returns to the pump portion P through the space 13 of the motor portion M and the returning path 34, is established. Accordingly, the fluid assumes a role of cooling the rotor 15, the stator 16 and so on by extracting heat of such components, in the space 13 of the motor portion M.

Next, operation of the electrically operated hydraulic pump 1 according to the embodiment will be described hereinafter. As described above, the electrically operated hydraulic pump 1 includes the motor portion M and the pump portion P. The motor portion M includes the brushless DC motor. The brushless DC motor includes the stator 16 having plural exciting coils 18 which generates the magnetic field, the rotor 15 having the magnet 15*a* which faces the exciting coils 18 and is arranged to be rotatable with the rotating shaft 14 in the space 13 of the resin-mold hollow and cylindrical motor housing 10, and the rotation controlling means 43 for controlling the rotation of the rotor 15 by switching the electric current to the exciting coils 18. Further, the electrically operated hydraulic pump 1 includes a fluid temperature detecting means 45. The fluid temperature detecting means 45 corresponds to a motor operating condition detecting means 44, which detects an operating condition of the motor portion M. The rotation controlling means 43 is configured to switch a first rotation controlling and a second rotation controlling, for controlling the rotation of the rotor 15, on the basis of a result detected by the fluid temperature detecting means 45 serving as the motor operating condition detecting means 44. In other words, according to the embodiment, fluid temperature detected by the fluid temperature detecting means 45 corresponds to an operating condition of the motor portion M. Here, the first rotation controlling is based on a rotational position of the rotor 15 detected by a first rotor position detecting means 41, and the second rotation controlling is based on a rotational position of the rotor 15 detected by a second rotor position detecting means 50.

The fluid temperature detecting means 45 includes at least either a fluid temperature measuring means 45*a* or a fluid temperature estimating means 45*b*. The fluid temperature detecting means 45*a* measures the temperature of the fluid directly, while the fluid temperature estimating means 45*b* estimates the temperature of the fluid by means other than a fluid temperature parameter. As one of the parameter (i.e., the parameter relating to the temperature of the fluid), which the fluid temperature estimating means 45*b* utilizes for estimating the fluid temperature, for example temperature of cooling water (cooling water of a radiator) for cooling an internal combustion engine of a vehicle, can be used. According to the embodiment, the fluid temperature can be detected by using either the fluid temperature measuring means 45*a* or the fluid temperature estimating means 45*b*. Further, either a result of the fluid temperature detected by the fluid temperature measuring means 45*a* or a result of the fluid temperature detected by the fluid temperature estimating means 45*b* is selectively employed on the basis of a certain condition.

The fluid temperature detecting means 45 may detect the temperature of the fluid flowing in the pump portion P, or may detect temperature of the fluid in the space 13 of the motor portion 13. In a case where the fluid temperature detecting means 45 detects temperature of the fluid flowing in the pump portion P, for example, the fluid temperature detecting means 45 (here, corresponding to the fluid temperature measuring means 45*a*) may be provided at a fluid flowing channel (not illustrated) communicated with the intake port 37 or with the exhaust port 38. On the other hand, in a case where the fluid temperature detecting means 45 detects the temperature of the fluid flowing in the space 13 of the motor portion M, the fluid temperature detecting means 45 (here, corresponding to the fluid temperature measuring means 45*a*) may be provided in the space 13 of the motor portion M. According to the embodiment, the fluid temperature detecting means 45 may be provided wherever possible, as long as the fluid temperature detecting means 45 are arranged to detect the temperature of the fluid.

More specifically, when the fluid temperature detected by the fluid temperature detecting means 45 is higher than a set temperature condition, the rotation controlling means 43 controls the rotation of the rotor 15 on the basis of the rotational position of the rotor 15 detected by the first rotor position detecting means 41, i.e., the rotation controlling means 43 implements the first rotation controlling. On the other hand, when the fluid temperature detected by the fluid temperature detecting means 45 is lower than the set temperature condition, the rotation controlling means 43 controls the rotation of the rotor 15 on the basis of the rotational position of the rotor 15 detected by the second rotor position detecting means 50, i.e., the rotation controlling means 43 implements the second rotation controlling.

The first rotor position detecting means 41 includes a speed electromotive force detecting means 42, and detects the rotational position of the rotor 15 on the basis of a result detected by the speed electromotive force detecting means 42, which detects speed electromotive force induced by the exciting coils 18. More specifically, as illustrated in FIG. 4, the speed electromotive force detecting means 42 outputs a detected result regarding a zero cross point of the speed electromotive force, which is induced by each of U phase, V phase, and W phase, of non-energized exciting coils 18. Consequently, the first rotational position detecting means 41 can detect the rotational position of the rotor 15 on the basis of the speed electromotive force detecting means 42.

The second rotor position detecting means 50 includes a sensor unit 52, which is located at opposite of the pump portion P, i.e., which is located at the other end of the rotating shaft 11, and serves as a magnetic field detecting unit. The sensor unit 52 detects magnetic field from a magnet 21 (for example, a dipolar permanent magnet) provided at the other end of the rotating shaft 14. Further, the sensor unit 52 includes a plurality of hole IC and detects magnetic field formed by the permanent magnet 21, at an outside of the bottom portion 10*a* of the motor housing 10. Then, the second rotor position detecting means 50 detects the rotational position of the rotor 15 on the basis of the result detected by the sensor unit 52. More specifically, the second rotor position detecting means 50 includes a memory unit 51 and a calculation processing unit 53. The memory unit 51 memorizes a relationship between the rotational position of the rotor 15 and the magnetic field detected by the sensor unit 52. The calculation processing unit 53 calculates the rotational position of the rotor 15 on the basis of the relationship memorized in the memory unit 51 and the result detected by the sensor unit 52. Then, information regarding the calculated rotational position of the rotor 15 is outputted from an output unit 54, which is included in the second rotor position detecting means 50, to the rotation controlling means 43. As described above, the memory unit 51 memorizes the relationship between the rotational position of the rotor 15 and the magnetic field detected by the sensor unit 52. Accordingly, the calculation processing unit 53 readily and accurately calculates the rotational position of the rotor 15.

As described above, the sensor unit 52, which is included in the second rotor position detecting means 50, detects the magnetic field formed by the permanent magnet 21, which is provided at the other end of the rotating shaft 14 and is arranged in the space 13 of the motor housing 10, from the outside of the motor housing 10. Accordingly, it is preferable that a distance between the sensor unit 52 and the permanent magnet 21 is smaller. According to the embodiment, the recessed portion 22, of which diameter is smaller than the inner diameter of the recessed portion 22, is formed at the outer surface of the bottom portion 10*a* of the motor housing 10 to be coaxial with the rotating shaft 14. The sensor unit 52 of the second rotor position detecting means 50 is provided at the recessed portion 22. Accordingly, the sensor unit 52 can detect the magnetic field formed by the permanent magnet 21 provided at the second end of the rotating shaft 14, with higher sensitivity. Therefore, the detection precision of the sensor unit 52 to detect the rotational position of the rotor 15 may be enhanced. Further, according to the embodiment, a recess 23 is formed at a center of the recessed portion 22 formed at the outside of the bottom portion 10*a* of the motor housing 10. Then, the sensor unit 52 of the second rotor position detecting means 50 is provided at the recess 23 formed at the recessed portion 22. Here, a position to provide the permanent magnet 21 relative to the rotating shaft 14, and a position to provide the sensor unit 52 of the second rotor position detecting means 50 are not limited to the configuration described above and can be modified.

Here, in a case where the temperature of the fluid is low, the viscosity of the fluid is higher (i.e., the fluid can become large rotational resistance to the rotor 15). Therefore, the rotational speed of the rotor 15 is lowered. On the other hand, in a case where the temperature of the fluid is high, the viscosity of the fluid is lower (i.e., the rotor 15 may not be the large rotational resistance to the rotor 15). Therefore, the rotational speed of the rotor 15 is increased. Accordingly, when the temperature of the fluid becomes higher (i.e., the rotational speed of the rotor 15 becomes higher), the first rotor position detecting means 41 detects the rotational position of the rotor 15 with higher detection precision. However, when the temperature of the fluid becomes lower (i.e., when the rotational speed of the rotor 15 becomes lower), the first rotor position detecting means 41 may detect the rotational position of the rotor 15 with lower detection precision. On the other hand, even when the temperature of the fluid is low (i.e., the rotational speed of the rotor 15 is low), the second rotor position detecting means 50 detects the rotational position of the rotor 15 with sufficiently high detection precision. However, when the temperature of the fluid rises, temperature of the permanent magnet 21 fixedly provided at the rotating shaft 14 also rises. Accordingly, magnetic force of the permanent magnet 21 becomes weaker, and the detection precision of the second rotor position detecting means 50, to detect the rotational position of the rotor 15, may be weaken.

Accordingly, when the fluid temperature detected by the fluid temperature detecting means 45 is higher than the set temperature condition (for example, when the fluid temperature is equal to, or higher than a set temperature threshold value), the rotation controlling means 43 controls the rotation of the rotor 15 on the basis of the first rotor position detecting means 41, i.e., the rotation controlling means 43 implements the first rotation controlling. On the other hand, when the fluid temperature detected by the fluid temperature detecting means 45 is lower than the set temperature condition (for example, when the temperature of the fluid is equal to, or lower than the set temperature value), the rotation controlling means 43 controls the rotation of the rotor 15 on the basis of the second rotor position detecting means 50, i.e., the rotation controlling means 43 implements the second rotation controlling.

As described above, the rotation controlling means 43 switches the first rotation controlling based on the result detected by the first rotor position detecting means and the second rotation controlling based on the result detected by the second rotor position detecting means, for controlling the rotation of the rotor 15. Therefore, a phenomenon such that the detection precision of the first rotor position detecting means to detect the rotational position of the rotor 15 lowers when the fluid temperature is low (i.e., when the rotational speed of the rotor 15 is low), and a phenomenon such that the detection precision of the second rotor position detecting means to detect the rotational position of the rotor 15 lowers when the fluid temperature is high (i.e., when the rotational speed of the rotor 15 is high), may be solved.

According to the electrically operated hydraulic pump 1 of the present invention, the above-described set temperature condition is appropriately set in accordance with a temperature characteristic of the fluid, the characteristic of the motor portion M, and so on. For example, the set temperature condition includes a set temperature threshold value assigned as zero degree Celsius. In such a case, the rotation controlling means 43 controls the electric current to the exciting coils 18 in accordance with the rotational position of the rotor 15 detected by the second rotor position detecting means 50, when the fluid temperature is lower than zero degree Celsius upon the fluid temperature rising. When the fluid temperature becomes equal to, or higher than zero degree Celsius upon the fluid temperature rising, the rotation controlling means 43 controls the electric current to the exciting coils 18 in accordance with the rotational position of the rotor 15 detected by the first rotor position detecting means 41. Further, when the fluid temperature becomes equal to, or lower than zero degree Celsius upon the fluid temperature being lowered, the rotation controlling means 43 controls the electric current to the exciting coils 18 in accordance with the rotational position of the rotor 15 detected by the second rotor position detecting means 50.

Modified Embodiments (1) In the aforementioned embodiment, a configuration of the motor operating condition detecting means 44 is described such that the motor operating condition detecting means 44 corresponds to the fluid temperature detecting means 45, and the operating condition of the motor portion M corresponds to the fluid temperature detected by the fluid temperature detecting means 45. Alternatively, modified configurations of the motor operating condition detecting means 44 may be employed. For example, the operating condition of the motor portion M detected by the motor operating condition detecting means 44 may correspond to a rotational speed of the motor portion M (i.e. the rotational speed of the rotor 15). Here, the rotation controlling means 43 can recognize not only the rotational position of the rotor 15, but also the rotational speed of the rotor 15, on the basis of the result detected by the first rotor position detecting means 41 or the second rotor position detecting means 50. Accordingly, at least either the first rotor position detecting means 41 or the second rotor position detecting means 50 may be employed as the operation condition detecting means 44. Then, the rotation controlling means 43 is configured to switch the first rotation controlling, which is based on the rotational position of the rotor 15 detected by the first rotor position detecting means 41, and second rotation controlling, which is based on the rotation position of the rotor 15 detected by the second rotor position detecting means 50, on the basis of a result detected by the motor operating condition detecting means 44.

More specifically, when the rotation speed of the rotor 15 is higher than a set rotational speed condition, the rotation controlling means 43 controls the rotation of the rotor 15 on the basis of the rotational speed of the rotor 15 detected by the first rotor position detecting means 41, i.e., the rotation controlling means 43 implements the first rotation controlling. On the other hand, when the rotation speed of the rotor 15 is lower than the set rotational speed condition, the rotation controlling means 43 controls the rotation of the rotor 15 on the basis of the second rotor position detecting means 50, i.e., the rotation controlling means 43 implements the second rotation controlling. Accordingly, a phenomenon such that the detection precision of the first rotor position detecting means 41 to detect the rotational position of the rotor 15 lowers when the rotational speed of the rotor 15 is low (i.e., when the fluid temperature is low) and a phenomenon such that the detection precision of the second rotor position detecting means 50 to detect the rotational position of the rotor 15 lowers when the rotational speed of the rotor 15 is high (i.e., when the fluid temperature is high) may be solved. In addition, the rotation controlling means 43 is configured to switch the first rotation controlling, which is based on the rotational position of the rotor 15 detected by the first rotor position detecting means 41, and the second rotation controlling, which is based on the rotation position of the rotor 15 detected by the second rotor position detecting means 50, on the basis of a combination of the set temperature condition and the set rotational speed condition, both which are described above.

(2) In the embodiment described above, the set condition of the fluid temperature is defined as one set temperature threshold value. Alternatively, the set condition of the fluid temperature may include plural set temperature threshold values. For example, the set condition of the fluid temperature may include first set temperature threshold value, which is employed when the fluid temperature is rising, and a second set temperature threshold value, which is set to be lower than the first set temperature threshold value and is employed when the fluid temperature is being lowered. An operation of the rotation controlling means 43, in a condition where the first set temperature threshold value is assigned as zero degree Celsius and the second set temperature threshold value is assigned as ten degrees Celsius below zero, will be described hereinafter. In such a case, when the fluid temperature is rising and the value of fluid temperature is below zero degree Celsius, the rotation controlling means 43 controls the electric current to the exciting coils 18 in accordance with the rotational position of the rotor 15 detected by the second rotor position detecting means 50. When the fluid temperature is rising and the value of the fluid temperature exceeds zero degree Celsius, the rotation controlling means 43 controls the electric current to the exciting coils 18 in accordance with the rotational position of the rotor 15 detected by the first rotor position detecting means 41. Further, when the fluid temperature is being lowered and the value of the fluid temperature lowers to 10 degrees Celsius below zero, the rotation controlling means 43 controls energizing the electric current to the exciting coils 18 in accordance with the rotational position of the rotor 15 detected by the second rotor position detecting means 50.

According to a condition where the set condition of the fluid temperature is defined as one set temperature threshold value as described in the aforementioned embodiment, the rotation controlling means 43 is required to switch the first rotation controlling, which is based on the rotational position of the rotor 15 detected by the first rotor position detecting means 41, and the second rotational control, which is based on the rotation position of the rotor 15 detected by the second rotor position detecting means 50, every time the fluid temperature rises over and lowers below the set temperature threshold value. In other words, when the fluid temperature is at a value around the set temperature threshold value, control hunting may occur. However, as described above, the set temperature threshold value upon the fluid temperature rising and the set temperature threshold value upon the fluid temperature being lowered may be set by different values. Therefore, the control hunting described above may be prevented from being generated.

In the same manner, as described in the modified embodiment (1), when the operating condition of the motor portion M (rotor 15) detected by the motor operating condition detecting means 44 corresponds to the rotational speed of the motor portion M (rotor 15), the set rotational speed condition may include plural set rotational speed threshold values. For example, the set rotational speed condition may include a first set rotational speed threshold value, which is employed when the rotational speed of the rotor 14 is rising, and a second set rotational speed threshold value, which is set to be lower than the first set rotational speed threshold value and is employed when the fluid temperature is being lowered.

(3) According to the electrically operated hydraulic pump in the embodiment described above, the pump portion P is arranged to close the opening of the motor housing 10, and the returning path 34 is formed between the motor portion M and the pump portion P so that the fluid flowing into the space 13 of the motor portion M from the pump portion P returns to the pump portion P. However, the configuration of the electrically operated hydraulic pump is not limited as described above and may be modified. For example, the fluid may not necessarily circulate between the motor portion and the pump portion. In addition, the electrically operated hydraulic pump may not necessarily be formed with the returning path as described above.

Due to the above described structure, the rotation control means 43 switches the first rotation controlling based on the rotational position of the rotor 15 detected by the first rotor position detecting means 41 and the second rotation controlling based on the rotational position of the rotor 15 detected by the second rotor position detecting means 50, on the basis of the result detected by the motor operating condition detecting means 44. In other words, the first rotation controlling, which is based on the rotational position of the rotor 15 detected by the first rotor position detecting means 41, is implemented on the condition where the operating condition of the motor portion M based on the rotational position of the rotor 15 detected by the first rotor position detecting means 41, is more accurate. On the other hand, the second rotation controlling, which is based on the rotational position of the rotor 15 detected by the second rotor position detecting means 50, is implemented on the condition where the operating condition of the motor portion M based on the rotational position of the rotor 15 detected by the second rotor position detecting means 50, is more accurate. Here, rotational speed of the rotor 15, the fluid temperature, and a combination of the fluid temperature and the rotational speed of the rotor 15, may be employed as the operating condition of the motor portion M, which is detected by the motor operating condition detecting means 44. Accordingly, the electrically operated hydraulic pump 1, which appropriately controls rotation of a motor portion M regardless of an operating condition of the motor portion M, may be provided.

According to the above described embodiment, the pump portion P, of the electrically operated hydraulic pump 1, is arranged to close the opening of the motor housing 10. In addition, the electrically operated hydraulic pump 1 further includes a fluid returning path 34, which is provided between the motor portion M and the pump portion P so as to return fluid flowing into the space 13 of the motor portion M to the pump portion P. Further, the sensor unit 52 of the second rotor position detecting means 50 detects the magnetic field of the permanent magnet 21, which is provided at the other end of the rotating shaft 14 in the space 13 of the motor portion M, from an outside of a bottom portion 10*a* of the motor housing 10.

Due to the above described structure, the fluid flows into the space 13 of the motor portion M from the pump portion P and returns to the pump portion P. In other words, the fluid assumes a role of cooling the motor portion M. In such condition, the fluid flowing into the space 13 of the motor portion M can become rotational resistance to the rotor 15 of the motor portion M so that the operating condition of the motor portion M is largely changed in accordance with a change of viscosity of the fluid. Accordingly, below such the condition where the operating condition of the motor portion M can be changed, it is effective that the rotation controlling means 43 switches the first rotation controlling based on the rotational position of the rotor 15 detected by the first rotor position detecting means 41, and the second rotation controlling based on the rotational position of the rotor 15 detected by the second rotor position detecting means 50, in accordance with the operating condition detected by the motor operating condition detecting means 44.

Further according to the above described embodiment, the electrically operated hydraulic pump 1 further includes a recessed portion 22, which is provided at the outside of the bottom portion 10*a*, of the motor housing 10, to be coaxial with the rotating shaft 14 and which has a diameter smaller than an inner diameter of the stator 16. Further, the sensor unit 52 of the second rotor position detecting means 50 is arranged at the recessed portion 22 coaxially with the rotating shaft.

Due to the above described structure, a distance between the sensor unit 52 of the second rotor position detecting means 50 and the permanent magnet 21 provided at the other end of the rotating shaft 14 can be arranged smaller. In other wards, the sensor unit 52 can detect the magnetic field formed by the permanent magnet 21 with higher sensitivity. Accordingly, the detection precision to detect the rotational position of the rotor 15 may be enhanced.

Still further according to the embodiment described above, the motor operating condition detecting means 44 includes fluid temperature detecting means 45 for detecting a fluid temperature, and in such a case, the fluid temperature corresponds to the operating condition of the motor portion M. Then, the rotation controlling means 43 implements the first rotation controlling, which is based on the rotational position of the rotor 15 detected by the first rotor position detecting means 41, when the fluid temperature detected by the fluid temperature detecting means 45 is higher than a set fluid temperature condition. On the other hand, the rotational controlling means 43 implements the second rotation controlling, which is based on the rotational position of the rotor 15 detected by the second rotor position detecting means 50, when the fluid temperature detected by the fluid temperature detecting means 45 is lower than the set fluid temperature condition. Further, the rotation controlling means 43 implements at least one of the first and second rotation controllings when the fluid temperature detected by the fluid temperature detecting means 45 is equal to the set fluid temperature condition.

When the fluid temperature is low (i.e., when the rotational speed of the rotor 15 is low), the detection precision of the first rotor position detecting means 41 to detect the rotational position of the rotor 15 becomes lower. On the other hand, when the fluid temperature is high (i.e., when the rotational speed of the rotor 15 is high), the detection precision of the second rotor position detecting means 50 to detect the rotational position of the rotor 15 becomes lower. However, due to the above described structure and characteristic, the rotation controlling means 43 implements the first rotation controlling based on the result detected by the first rotor position detecting means 41 when the fluid temperature detected by the fluid temperature detecting means 45 is higher than the set temperature condition (for example, when the fluid temperature is equal to, or higher than a set temperature threshold value). On the other hand, the rotation controlling means 43 implements the second rotation controlling based on the result detected by the second rotor position detecting means 50 when the fluid temperature detected by the fluid temperature detecting means 45 is lower than the set temperature condition (for example, when the fluid temperature is equal to, or lower than the set temperature threshold value). Accordingly, the phenomenon described above may be solved because the rotation controlling means 43 switches the first rotation controlling and the second rotation controlling, in accordance with the fluid temperature detected by the fluid temperature detecting means.

Still further according to the above described embodiment, the fluid temperature detecting means 45 includes at least one of fluid temperature measuring means 45*a* for measuring the fluid temperature, and fluid temperature estimating means 45*b* for estimating the fluid temperature.

Due to the above described structure, the fluid temperature is detected directly by the fluid temperature measuring means 45*a*, or indirectly by the fluid temperature estimating means 45*b*. For example, in a case where the electrically operated hydraulic pump 1 is mounted on a vehicle such as an automobile or the like, the fluid temperature is estimated, by the fluid temperature estimating means 45*b*, from temperature of a radiator cooling water, or the like.

Still further according to the above described embodiment, the set fluid temperature condition includes a first fluid temperature threshold value which is employed when the fluid temperature is rising, and a second fluid temperature threshold value which is lower than the first fluid temperature threshold value and is employed when the fluid temperature is lowering.

In a condition where the set condition of the fluid temperature is defined as one set temperature threshold value, the rotation controlling means 43 needs to switch the first rotation controlling and the second rotational controlling every time the fluid temperature rises over and lowers below the set temperature threshold value. In other words, when the fluid temperature is at a value around the set temperature threshold value, control hunting may occur. However, due to the above described structure, the set temperature threshold value upon the fluid temperature rising and the set temperature threshold value upon the fluid temperature being lowered may be set by different values. Therefore, the control hunting described above may be prevented from being generated.

Still further according to the above described embodiment, the second rotor position detecting means 50 further includes a memory unit 51, which memorizes a relationship between the magnetic field detected by the sensor unit 52 of the second rotor position detecting means 50 and the rotational position of the rotor 15, and a calculation processing unit 53, which calculates the rotational position of the rotor 15 on the basis of the relationship memorized in the memory unit 51 and the result detected by the sensor unit 52.

Due to the above described structure, the memory unit 51 memorizes a relationship between the magnetic field detected by the sensor unit 52 and the rotational position of the rotor 15. Accordingly, the calculation processing unit 53 readily and accurately calculates the rotational position of the rotor 15. Therefore, the rotation controlling means 43 appropriately implements the second rotation controlling on the basis of the rotational position of the rotor 15 detected by the second rotor position detecting means 50.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. An electrically operated hydraulic pump, comprising:

a motor portion including a hollow and cylindrical motor housing with a bottom and an opening, the motor portion including a brushless DC motor with a stator fixedly provided in the motor housing, a plurality of exciting coils generating magnetic field, a rotating shaft arranged at a space in the motor housing to be rotatable relative to the stator, a rotor arranged at the space in the motor housing and fixed to the rotating shaft, the rotor including a first magnet facing the exciting coils, and a rotation control means controlling a rotation of the rotor by switching energizing electric current flow from an exciting coil from among the exciting coils to another exciting coil from among the exciting coils in accordance with a rotational position of the rotor;

a pump portion connected to one end of the rotating shaft, the pump portion absorbing and exhausting fluid by driving force of the rotating shaft;

first rotor position detecting means including speed electromotive force detecting means for detecting speed electromotive force induced by the exciting coils, the first rotor position detecting means detecting the rotational position of the rotor on the basis of a result detected by the speed electromotive force detecting means;

second rotor position detecting means including a second magnet provided at the rotating shaft and a magnetic field detecting unit detecting a magnetic field of the second magnet, the second rotor position detecting means detecting the rotational position of the rotor on the basis of a result detected by the magnetic field detecting unit; and motor operating condition detecting means detecting an operating condition of the motor portion, wherein the rotation control means of the motor portion is configured to switch a first rotation controlling based on the rotational position of the rotor detected by the first rotor position detecting means and a second rotation controlling based on the rotational position of the rotor detected by the second rotor position detecting means on the basis of a result detected by the motor operating condition detecting means.

2. An electrically operated hydraulic pump according to claim 1, wherein the pump portion is arranged to close the opening of the motor housing, and the electrically operated hydraulic pump further comprising:

a fluid returning path provided between the motor portion and the pump portion so as to return fluid flowing into the space of the motor portion from the pump portion to the pump portion, wherein the magnetic field detecting unit of the second rotor position detecting means detects the magnetic field of the second magnet provided at the other end of the rotating shaft in the space of the motor portion from an outside of a bottom portion of the motor housing.

3. An electrically operated hydraulic pump according to claim 2, further comprising:

a recessed portion provided at the outside of the bottom portion to be coaxial with the rotating shaft and having a diameter smaller than an inner diameter of the stator, wherein, the magnetic field detecting portion is arranged at the recessed portion coaxially with the rotating shaft.

4. An electrically operated hydraulic pump according to claim 1, wherein, the motor operating condition detecting means includes fluid temperature detecting means for detecting a fluid temperature being the operating condition of the motor portion, the rotation control means implements the first rotation controlling based on the rotational position of the rotor detected by the first rotor position detecting means when the fluid temperature detected by the fluid temperature detecting means is higher than a set fluid temperature condition, and wherein the rotational control means implements the second rotation controlling based on the rotational position of the rotor detected by the second rotor position detecting means when the fluid temperature detected by the fluid temperature detecting means is lower than the set fluid temperature condition.

5. An electrically operated hydraulic pump according to claim 4, wherein, the fluid temperature detecting means includes at least one of fluid temperature measuring means for measuring the fluid temperature and fluid temperature estimating means for estimating the fluid temperature.

6. An electrically operated hydraulic pump according to claim 4, wherein, the set fluid temperature condition includes a first fluid temperature threshold value employed when the fluid temperature is rising and a second fluid temperature threshold value lower than the first fluid temperature threshold value and employed when the fluid temperature is lowering.

7. An electrically operated hydraulic pump according to claim 2, wherein, the motor operating condition detecting means includes fluid temperature detecting means for detecting a fluid temperature being the operating condition of the motor portion, the rotation control means implements the first rotation controlling based on the rotational position of the rotor detected by the first rotor position detecting means when the fluid temperature detected by the fluid temperature detecting means is higher than a set fluid temperature condition, and wherein the rotational control means implements the second rotation controlling based on the rotational position of the rotor detected by the second rotor position detecting means when the fluid temperature detected by the fluid temperature detecting means is lower than the set fluid temperature condition.

8. An electrically operated hydraulic pump according to claim 3, wherein, the motor operating condition detecting means includes fluid temperature detecting means for detecting a fluid temperature being the operating condition of the motor portion, the rotation control means implements the first rotation controlling based on the rotational position of the rotor detected by the first rotor position detecting means when the fluid temperature detected by the fluid temperature detecting means is higher than a set fluid temperature condition, and wherein the rotational control means implements the second rotation controlling based on the rotational position of the rotor detected by the second rotor position detecting means when the fluid temperature detected by the fluid temperature detecting means is lower than the set fluid temperature condition.

9. An electrically operated hydraulic pump according to claim 5, wherein, the set fluid temperature condition includes a first fluid temperature threshold value employed when the fluid temperature is rising and a second fluid temperature threshold value lower than the first fluid temperature threshold value and employed when the fluid temperature is lowering.

10. An electrically operated hydraulic pump according to claim 1, wherein, the second rotor position detecting means further including:

a memory unit memorizing a relationship between the magnetic field detected by the magnetic field detecting means and the rotational position of the rotor; and a calculation processing unit calculating the rotational position of the rotor on the basis of the relationship memorized in the memory unit and the result detected by the magnetic field detecting unit.

11. An electrically operated hydraulic pump according to claim 2, wherein, the second rotor position detecting means further including:

a memory unit memorizing a relationship between the magnetic field detected by the magnetic field detecting means and the rotational position of the rotor; and a calculation processing unit calculating the rotational position of the rotor on the basis of the relationship memorized in the memory unit and the result detected by the magnetic field detecting unit.

12. An electrically operated hydraulic pump according to claim 3, wherein, the second rotor position detecting means further including:

a memory unit memorizing a relationship between the magnetic field detected by the magnetic field detecting means and the rotational position of the rotor; and a calculation processing unit calculating the rotational position of the rotor on the basis of the relationship memorized in the memory unit and the result detected by the magnetic field detecting unit.

13. An electrically operated hydraulic pump according to claim 4, wherein, the second rotor position detecting means further including:

a memory unit memorizing a relationship between the magnetic field detected by the magnetic field detecting means and the rotational position of the rotor; and a calculation processing unit calculating the rotational position of the rotor on the basis of the relationship memorized in the memory unit and the result detected by the magnetic field detecting unit.

14. An electrically operated hydraulic pump according to claim 5, wherein, the second rotor position detecting means further including:

a memory unit memorizing a relationship between the magnetic field detected by the magnetic field detecting means and the rotational position of the rotor; and a calculation processing unit calculating the rotational position of the rotor on the basis of the relationship memorized in the memory unit and the result detected by the magnetic field detecting unit.

15. An electrically operated hydraulic pump according to claim 6, wherein, the second rotor position detecting means further including:

a memory unit memorizing a relationship between the magnetic field detected by the magnetic field detecting means and the rotational position of the rotor; and a calculation processing unit calculating the rotational position of the rotor on the basis of the relationship memorized in the memory unit and the result detected by the magnetic field detecting unit.

16. An electrically operated hydraulic pump according to claim 7, wherein, the second rotor position detecting means further including:

a memory unit memorizing a relationship between the magnetic field detected by the magnetic field detecting means and the rotational position of the rotor; and a calculation processing unit calculating the rotational position of the rotor on the basis of the relationship memorized in the memory unit and the result detected by the magnetic field detecting unit.

17. An electrically operated hydraulic pump according to claim 8, wherein, the second rotor position detecting means further including:

a memory unit memorizing a relationship between the magnetic field detected by the magnetic field detecting means and the rotational position of the rotor; and a calculation processing unit calculating the rotational position of the rotor on the basis of the relationship memorized in the memory unit and the result detected by the magnetic field detecting unit.

18. An electrically operated hydraulic pump according to claim 9, wherein, the second rotor position detecting means further including:

a memory unit memorizing a relationship between the magnetic field detected by the magnetic field detecting means and the rotational position of the rotor; and a calculation processing unit calculating the rotational position of the rotor on the basis of the relationship memorized in the memory unit and the result detected by the magnetic field detecting unit.

19. An electrically operated hydraulic pump according to claim 4, wherein the rotation control means implements at least one of the first and second rotation controllings based on the rotational position of the rotor detected by at least one of the first rotor position detecting means and the second rotor position detecting means when the fluid temperature detected by the fluid temperature detecting means is equal to the set fluid temperature condition.

* * * * *